US005711426A

United States Patent [19]

Kuhn et al.

[11] Patent Number: 5,711,426

[45] Date of Patent: Jan. 27, 1998

[54] CORNER PROTECTOR APPARATUS

[75] Inventors: Wayne H. Kuhn, Palos Park; Scott Imhoff, Arlington Heights, both of Ill.

[73] Assignee: Stone Container Corporation, Chicago, Ill.

[21] Appl. No.: 772,881

[22] Filed: Dec. 26, 1996

[51] Int. Cl.[6] ..... B65D 71/00

[52] U.S. Cl. ..... 206/586; 206/591

[58] Field of Search ..... 206/521, 586, 206/591, 594, 524.9; 229/918

[56] References Cited

U.S. PATENT DOCUMENTS 3,955,677 5/1976 Collingwood ..... 206/586 X
4,899,888 2/1990 Shawler ..... 206/586

*Primary Examiner*—Jacob K. Ackun
*Attorney, Agent, or Firm*—Dick and Harris

[57] ABSTRACT

A corner protector apparatus for providing protection for the corner areas of substantially flat, rectangular, parallelpiped structures is provided. The corner protector apparatus includes one or more pairs of corner protector structures cooperatively formed from a single blank of suitable shock absorbing protective material which corner protector structures are advantageously configured to be readily separated for deployment and positioning upon respective corners of such a substantially flat rectangular parallelpiped structure for the facilitated covering and protection of same.

22 Claims, 2 Drawing Sheets

CORNER PROTECTOR APPARATUS

BACKGROUND OF THE INVENTION

1. Field of the Invention

The present invention is directed to apparatus which are used for the protection of goods, which goods may be subject to potential damage during transportation from their place of manufacture, as well as during the period of display up until the time of vending, and further during the period subsequent to their sale to arrival at their ultimate destination. Such articles include articles having a generally flat, rectangular parallelpiped configuration, such as picture and mirror frames, and the like. Such articles typically have structures having corner and side edges and surfaces which are provided with smooth, polished or elaborately configured surfaces and finishes which are susceptible to damage, marring, staining and the like.

2. The Prior Art

Prior practice has been to protect such articles by, for example, enclosing the entire article in a protective box or container or one or more layers of protective wrapping material. While such complete enclosure methods of protection have been effective, such methods are also costly in terms of the time and effort required to accomplish such packaging, as well as the costs of material and added weight added the goods, which may increase shipping costs.

It has been subsequently determined through experience that such complete enclosure-type packaging methods are not, in many cases, necessary to ensure the adequate protection of such articles, in that it has been found that the most typical location for damage to such articles is in the corner regions, and the side and end edge surfaces. Accordingly, in an effort to reduce the cost, time and effort associated with such complete enclosure type protection methods, alternative protection measures, involving simply the covering of the corner areas, around the adjoining edges and upper and lower surfaces adjacent thereto have been attempted. Typically, such corner protecting structures involve the use of separate individual strips of protective material, such as corrugated paperboard, polystyrene foam, etc., which are wrapped diagonally across each respective corner of a rectangular parallelpiped article. Each such strip would be affixed to itself, for example, by a staple or strip of adhesive tape, or glue or the like, and further, temporarily held in place upon the article, by a further strip of adhesive tape, etc. While an improvement over the complete enclosure type method of protection of such articles, such methods for protecting only the corner regions of such articles still involve the formation and affixation of the individual strips around the individual respective corners of such articles, which still involves significant manual work.

It would, accordingly, be desirable, to provide an improved apparatus for protecting the corners of substantially flat rectangular parallelpiped structures which would not require the manual forming of the corner protector structures for each respective corner of such an article.

It would therefore be desirable to provide an improved apparatus for protecting the corners of substantially flat rectangular parallelpiped structures which may be advantageously erected from substantially flat blanks using automatic formation equipment.

These and other objects of the invention will become apparent in light of the present specification, including claims and drawings.

SUMMARY OF THE INVENTION

An apparatus for the facilitated protection of two or more corner regions of an article, wherein at least two of the two or more corner regions each includes a front surface, a back surface disposed substantially opposite to the front surface and at least two intersecting side surfaces between said front and back surfaces.

The apparatus for the facilitated protection of two or more corner regions of an article comprising: a first front wall member; a first back wall member; a first pair of side wall members, each of which intersects the other, the first front, back and side wall members being operably disposed in spaced apart relation to one another, so as to define a corner receiving region, the first front, back and wall members further defining a first corner protector member, for substantially covering at least a portion of the front, back and side surfaces, respectively of a first corner region of an article.

The apparatus also comprises a second front wall member; a second back wall member; a second pair of side wall members, each of which intersects the other, the second front, back and side wall members being operably disposed in spaced apart relation to one another, so as to define another corner receiving region, the second front, back and side wall members further defining a second corner protector member, for substantially covering at least a portion of the front, back and side surfaces, respectively, of a second corner region of an article.

Frangibility means are provided for operably, yet separably connecting the first and second corner protector members to one another so as to enable their formation simultaneously, prior to deployment about respective first and second corner regions of an article.

The first and second corner protector members are preferably formed from a substantially flat articulable blank of paper material.

The first and second corner protector members are separably connected to one another, prior to deployment, between at least one of their respective first and second front wall members, and their respective first and second back wall members.

The frangibility means for operably separably connecting the first and second corner protector members to one another comprise at least one frangibility region disposed between at least one of the respective first and second front wall members, and the respective first and second back wall members, whereat the first and second corner protector members are separably connected to one another.

At least one side wall member of each first and second pair of side wall members comprises a first side wall portion operably emanating from a front wall member; a second side wall portion operably emanating from a corresponding back wall member, the first side wall portion and the second side wall portion being positionable in juxtaposed, substantially overlapping relationship to one another, when the front and back wall members are in spaced apart, substantially opposed parallel relationship to one another.

Means are provided for affixing the first side wall portion to the second side wall portion, when the front and back wall members are in their spaced apart, substantially opposed parallel relationship to one another.

At least one of the side wall members operably emanates from at least one of its corresponding front and back wall members, and is demarcated therefrom by a fold line.

In an alternative embodiment of the invention, the apparatus further comprises a third front wall member; a third back wall member; a third pair of side wall members, each of which intersects the other, the third front, back and side wall members being operably disposed in spaced apart relation to one another, so as to define a third corner receiving region.

The third front, back and side wall members further define a third corner protector member, for substantially covering at least a portion of the front, back and side surfaces, respectively, of a third corner region of an article. A fourth front wall member is provided, along with a fourth back wall member and a fourth pair of side wall members, each of which intersects the other.

The fourth front, back and side wall members are operably disposed in spaced apart relation to one another, so as to define a fourth corner receiving region. The fourth front, back and side wall members further define a fourth corner protector member, for substantially covering at least a portion of the front, back and side surfaces of a fourth corner region of an article. Means are provided for operably, yet separably connecting the third and fourth corner protector members to one another so as to enable their formation simultaneously, prior to deployment about respective third and fourth corner regions of an article.

Means are also provided for operably, yet separably connecting the first and second corner protector members to the third and fourth corner protector members, so as to enable their collective formation simultaneously, prior to deployment about first, second, third and fourth corner regions of an article.

The third and fourth corner protector members are also formed from a substantially flat articulable blank of paper material.

Preferably, the first, second, third and fourth corner protector members are all formed from a single, contiguous substantially flat articulable blank.

The third and fourth corner protector members are separably connected to one another, prior to deployment, between at least one of their respective third and fourth front wall members, and their respective third and fourth back wall members. The means for operably separably connecting the third and fourth corner protector members to one another comprise at least one frangibility region disposed between at least one of the respective third and fourth front wall members, and the respective third and fourth back wall members whereat the third and fourth corner protector members are separably connected to one another.

The means for operably separably connecting the third and fourth corner protector members to the first and second corner protector members comprise at least one frangibility region disposed between at least one of the respective third and fourth front wall members and the first and second front wall members, and the respective third and fourth back wall members and the first and second back wall members, whereat the third and fourth corner protector members are separably connected to the first and second corner protector members.

At least one side wall member of each third and fourth pair of side wall members comprises a first side wall portion operably emanating from a front wall member; a second side wall portion operably emanating from a corresponding back wall member. The first side wall portion and the second side wall portion are positionable in juxtaposed, substantially overlapping relationship to one another, when the front and back wall members are in spaced apart, substantially opposed parallel relationship to one another. Means are provided for affixing the first side wall portion to the second side wall portion, when the front and back wall members are in their spaced apart, substantially opposed parallel relationship to one another. At least one of the side wall members operably emanates from at least one of its corresponding front and back wall members, and is demarcated therefrom by a fold line.

The means for affixing comprise an adhesive material.

The invention also comprises a blank of substantially flat sheet material for forming, upon articulation, the apparatuses as described above.

The invention also comprises, in part, a method for forming an apparatus for the facilitated protection of two or more corner regions of an article, wherein at least two of the two or more corner regions each includes a front surface, a back surface disposed substantially opposite to the front surface and at least two intersecting side surfaces between said front and back surfaces.

The method comprises the steps of:

a) forming a blank having, at least, a first front wall member, a first back wall member, and a first pair of side wall members, one of the side wall members being disposed between the first front wall member and the first back wall member, the other of the side wall members being formed as two side wall portions, one side wall portion emanating from a free edge of the first front wall member and the other side wall portion emanating from a free edge of the first back wall member; and a second front wall member, a second back wall member, and a second pair of side wall members, one of the side wall members being disposed between the second front wall member and the second back wall member, the other of the side wall members being formed as two side wall portions, one side wall portion emanating from a free edge of the second front wall member and the other side wall portion emanating from a free edge of the second back wall member, the blank being formed so that the first and second front wall members, the first and second back wall members, and the respective side wall members disposed therebetween, are disposed substantially contiguously adjacent one another, respectively, with a line of frangibility disposed between the respective adjacent front, back and side wall members;

b) articulating the blank by folding so that the respective front and back wall members are disposed in spaced apart, substantially parallel relation to one another, the side wall members between the front and back wall members being disposed substantially perpendicular to the front and back wall members;

c) articulating the side wall portions emanating from the free edges of the front and back wall members so that the side wall portions from a corresponding pair of front and back wall members are disposed in substantially overlapping, juxtaposed relation to one another;

d) affixing the overlapped side wall portions to one another, so as to maintain the respective front and back wall in their spaced apart, substantially parallel relationship, so as to simultaneously form at least first and second corner protector members.

The method further comprises the steps of:

e) separating the at least first and second corner protector members, along the line of frangibility, so as to enable deployment of the at least first and second corner protector members, about respective first and second corner regions of an article.

In an alternative embodiment, the step for forming a blank further comprises the step of forming the blank to also have a third front wall member, a third back wall member, and a third pair of side wall members, one of the side wall members being disposed between the third front wall member and the third back wall member, the other of the side wall members being formed as two side wall portions, one side wall portion emanating from a free edge of the third front wall member and the other side wall portion emanating from a free edge of the third back wall member; and a fourth front wall member, a fourth back wall member, and a fourth pair of side wall members, one of the side wall members being disposed between the fourth front wall member and the fourth back wall member, the other of the side wall members being formed as two side wall portions, one side wall portion emanating from a free edge of the fourth front wall member and the other side wall portion emanating from a free edge of the fourth back wall member, the blank being formed so that the third and fourth front wall members, the third and fourth back wall members, and the respective side wall members disposed therebetween, are disposed substantially contiguously adjacent one another, respectively, with a line of frangibility disposed between the respective adjacent front, back and side wall members, the blank further being formed so that the first and second front wall members are disposed substantially contiguously adjacent to the third and fourth front wall members, the blank thus formed permitting, upon articulation and affixation of same, the simultaneous forming of first, second, third and fourth corner connector members.

Alternatively, the step for forming a blank further can comprise the step of forming the blank to also have third and fourth front wall members emanating from the first and second front wall members, respectively, third and fourth back wall members emanating from the first and second back wall members, respectively, and third and fourth pairs of side wall members, one pair of side wall members formed as mating side wall portions, emanating from free edges of the third and fourth front wall members and the third and fourth back wall members.

The blank is alternatively formed so that the third and fourth front wall members, are disposed substantially contiguously with the first and second front wall members, with a line of frangibility disposed therebetween, and the third and fourth back wall members, are disposed substantially contiguously with the first and second back wall members, with a line of frangibility disposed therebetween, the blank further being formed with a further pair of side wall members operably emanating from further respective free edges of one of the third and fourth front wall members and the third and fourth back wall members, and at least one attachment tab emanating from at least one of the further pair of side wall members, for affixed attachment to at least one of the other of the third and fourth front wall members and the third and fourth back wall members, upon articulation of the blank. The blank thus formed permits, upon articulation and affixation of same, the simultaneous forming of first, second, third and fourth corner connector members.

DETAILED DESCRIPTION OF THE INVENTION

Figure 1:
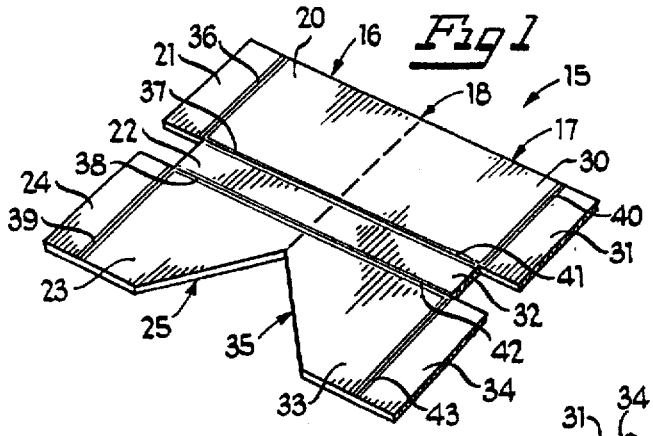
FIG. 1 is a perspective view of a blank for forming a corner protector apparatus according to one embodiment of the invention.

While this invention is susceptible of embodiment in many different forms, there is shown in the drawings and will be described in detail herein several preferred embodiments, with the understanding that the present disclosure is to be considered as an exemplification of the principles of the invention and is not intended to limit the invention to the embodiments illustrated.

FIG. 1 is a perspective view of a blank 15 for forming a corner protector apparatus according to one embodiment of the invention. Blank 15 includes half portions 16 and 17, which are preferably formed from a single blank of material, such as corrugated paperboard. Half portions 16 and 17 are divided by a perforated cut 18. Half portion 16 includes back wall 20, side wall portion 21, side wall 22, front wall 23, and side wall portion 24. Preferably, front wall 23 has a substantially triangular or pentagonal configuration, including diagonal edge 25.

Half portion 17, which is substantially a mirror image of half portion 16, includes back wall 30, side wall portion 31, side wall 32, front wall 33, side wall portion 34, and edge 35. Half portion 16 also includes fold line 36, 37, 38, and 39, while half portion 17 is provided with fold lines 40, 41, 42, and 43.

Figure 2:
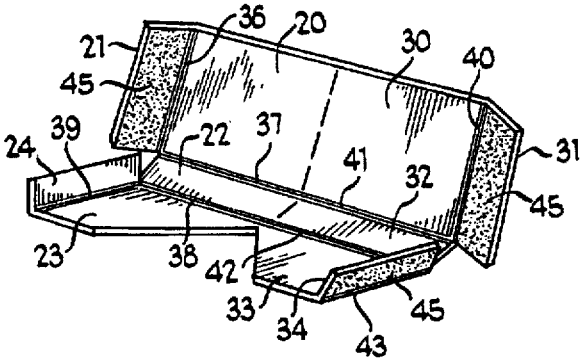
FIG. 2 is a perspective view of the blank for the corner protector apparatus according to FIG. 1, which has been partially articulated.
Figure 5:
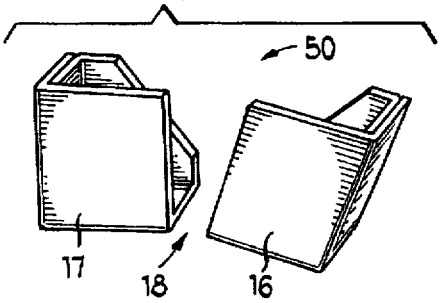
FIG. 5 is a perspective view of the corner protector apparatus according to FIGS. 1–4, which has been separated into separate individual corner protector members.

The formation of blank 15 into corner protector apparatus 50 (see FIGS. 3 and 4) is accomplished by first folding back walls 20 and 30 simultaneously toward their respective front walls 23 and 33 (FIG. 2), and by folding back walls 20 and 30 toward side walls 22 and 32 around fold lines 37 and 41, respectively. Likewise, front walls 23 and 33 are folded toward side walls 22 and 32, respectively, around fold lines 38 and 42, respectively. In addition, side wall portions 21 and 31 are folded toward their respective back walls 20 and 30 around fold lines 36 and 40, respectively, while side wall portions 24 and 34 are folded toward their respective front walls 23 and 33 around respective fold lines 39 and 43.

During the aforementioned articulation steps (which may be accomplished utilizing known carton or box forming techniques and apparatus), or before any of such articulation steps, adhesive material 45 is applied to one or both mating surfaces of at least one of side wall portions 21 and 24 and one or both mating surfaces of at least one of side wall portions 31 and 34.

Articulation of blank 15 is continued until back wall 30 is substantially parallel to front wall 33, back wall 20 is parallel to front wall 23, side wall portions 31 and 34 are parallel and disposed in overlying adjacent relationship to one another and side wall portions 24 and 21 are likewise disposed in parallel in overlying adjacent relationship to one another.

Figure 4:
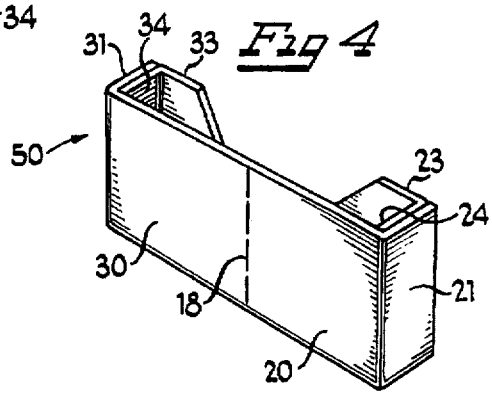
FIG. 4 is a further perspective view of the corner protector apparatus according to FIG. 3.
Figure 3:
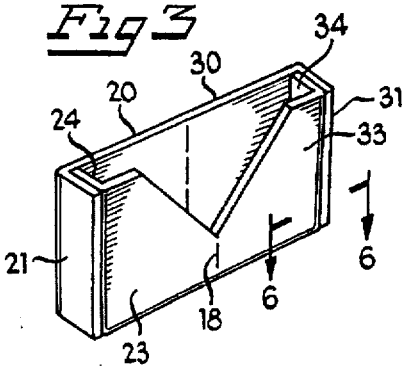
FIG. 3 is a perspective view of a corner protector apparatus which has been formed from the blank according to FIGS. 1 and 2.
Figure 6:
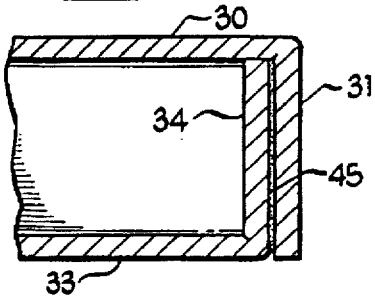
FIG. 6 is a fragmentary side elevation, in section, of the corner protector apparatus according to FIG. 3 taken along line 6—6.

As can be seen in FIG. 6, which is a fragmentary view in section of the right side of FIG. 3, blank 15, and, in particular, half portion 17 of blank 15, has been configured so that upon articulation, side wall portion 34 is positioned to the inside of side wall portion 31, with adhesive material 45 disposed therebetween. Similarly, side wall portion 24 is positioned to the inside of side wall portion 21, as seen in FIGS. 3 and 4. It may be readily understood that in an alternative configuration of the embodiment, the respective positions of the side wall portions could be reversed from that illustrated if so desired. As previously mentioned, adhesive material 45 will be disposed on one or both of the adjoining mating surfaces of respective cooperating side wall portions 31 and 34, and 21 and 24, as may be desired. For example, a hot melt adhesive may be applied to a surface of one or both of side wall portions 31 and 34, or side wall portions 21 and 24. Alternatively, a cohesive material may be applied to both mating surfaces of respective pair of side wall portions 31 and 34 and 21 and 24.

Figure 8:
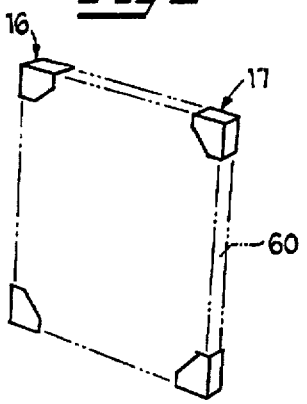
FIG. 8 is a perspective view of a rectangular parallelpiped structure having four corner protector members mounted thereon.

Once fully articulated, blank 15 forms a corner protector apparatus 50, as illustrated in FIGS. 3 and 4. Upon arrival at the location where apparatus 50 is to be applied to an article 60 (as shown in FIG. 8) apparatus 50 may be "broken" into erected half portions 16 and 17, along perforated cut line 18, with a simple bending and/or snapping motion. Thereafter, half portions 16 and 17 may be positioned upon an article 60 and held there, such as by removable adhesive material, friction fit, etc., for the facilitated protection of the corner areas of article 60. Article 60 may then be transported, as illustrated, or it may be further packaged in another container.

If the corner protector apparatus 50 is formed from a sufficiently thick blank material, such corner apparatus 50, when separated into its component half portions 16 and 17 and positioned upon respective corners of an article 60, can be utilized to facilitate the flat stacking of several articles 60 one atop another, as the thickness(es) of corner protector material, between adjacent articles 60, will help prevent undesired potentially damaging contact between adjacent articles 60 during stacking of same.

Figure 7:
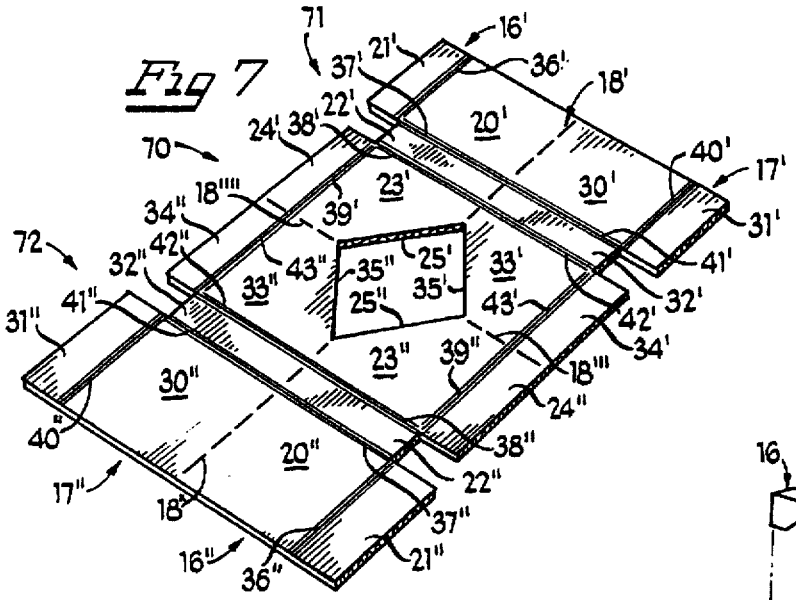
FIG. 7 is a perspective view of a blank for forming a corner protector apparatus according to another embodiment of the invention.

FIG. 7 illustrates a blank 70 configured for forming a corner protector apparatus according to an alternative embodiment of the invention, wherein elements having configurations, structures and/or modes of operation similar to those described with respect to the embodiment of FIGS. 1–6 and 8, are provided with like reference numerals augmented by a prime (') or double prime (").

From FIG. 7, it may readily be seen that articulation of the two respective half portions 71 and 72, each in turn comprising quarter portions 16' and 17' and 16" and 17" can be accomplished according to the same general steps described with respect to the articulation of blank 15 of the embodiment of FIGS. 1–6 and 8 to form a corner protector apparatus 70 (FIG. 9) which is substantially two corner protector apparatus 50, each of which can subsequently be broken into half portions 16', 17', 16", and 17", respectively. For this purpose, additional perforated cut lines 18'" and 18"" are provided. Corner protector apparatus 70 may be cut and articulated into its fully assembled configuration, as illustrated in FIG. 9, utilizing otherwise conventional carton or box forming apparatus and techniques by one of ordinary skill in the art having the present disclosure before them.

The present invention, in either of the disclosed embodiments, is advantageously configured to be fabricated substantially entirely using automated techniques and machinery, requiring manual work, if at all, only for the final placement of the corner protector structures on the actual article to be protected. The machinery necessary to articulate and affix the blanks into the finished corner protector apparatus may be obtained through modification of known blank articulating apparatus, by ones of ordinary skill in the art, having the present disclosure before them.

Figure 9:
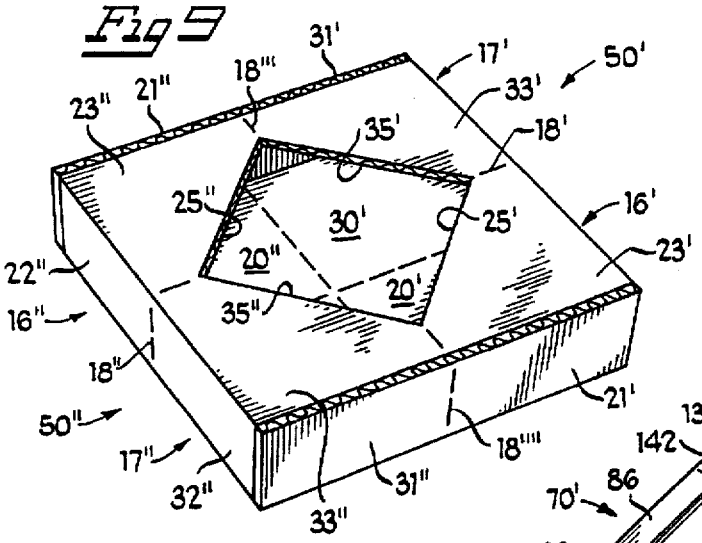
FIG. 9 is a perspective view of a corner protector apparatus formed from the blank of FIG. 7.
Figure 10:
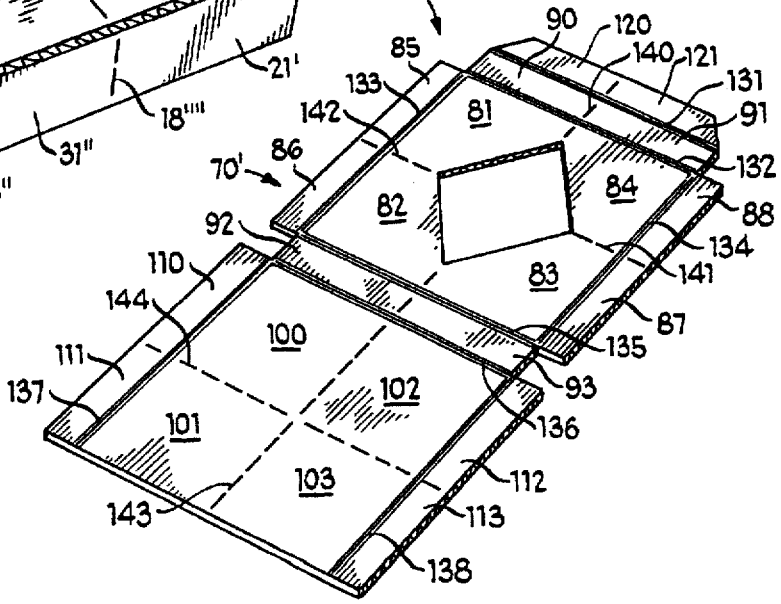
FIG. 10 is a perspective view of a blank for forming a corner protector apparatus according to still another embodiment of the invention.

An alternative embodiment of the blank for apparatus 70, in the embodiment of FIGS. 7 and 9 is shown in FIG. 10, and includes a blank 80 with top walls 81, 82, 83, 84; side wall portions 85–88; end walls 90–93; back walls 100–103; side wall portions 110–113; and attachment tabs 120 and 121. Fold lines 135–136 are provided to enable top walls 81–84 to be folded over to a position parallel to back walls 100–103. Fold lines 133, 134, 137, 138 permit side wall portions 85–88 and side wall portions 110–113 to be folded into overlying relationship with each other, in a manner generally similar to that described with respect to the prior two disclosed embodiments. To further affix the top walls in position with respect to the bottom walls, and provide further end walls, end walls 90–91 are folded to positions generally perpendicular with respect to the top and bottom walls, and attachment tabs 120, 121 are positioned to overlie portions of back walls 101, 103, respectively, and held in place with a suitable adhesive material. Except for the presence of attachment tabs 120, 121, the articulated and assembled apparatus 70' has an appearance which is substantially identical to that of apparatus 70, of FIG. 9. Perforated cut lines 140–144, permit apparatus 70' to be broken apart into four corner protector structures, following articulation of the blank 80 into its fully erected configuration.

The foregoing description and drawings merely serve to illustrate the invention, and the invention is not limited thereto except insofar as the appended claims are so limited, as those skilled in the art having the disclosure before them, will be able to make modifications and variations therein without departing from the scope of the invention.

We claim:

1. An apparatus for the facilitated protection of two or more corner regions of an article, wherein at least two of the two or more corner regions each includes a front surface, a back surface disposed substantially opposite to the front surface and at least two intersecting side surfaces between said front and back surfaces, the apparatus for the facilitated protection of two or more corner regions of an article comprising:

a first front wall member;

a first back wall member;

a first pair of side wall members, each of which intersects the other, the first front, back and side wall members being operably disposed in spaced apart relation to one another, so as to define a corner receiving region, the first front, back and side wall members further defining a first corner protector member, for substantially covering at least a portion of the front, back and side surfaces, respectively of a first corner region of an article;

a second front wall member;

a second back wall member;

a second pair of side wall members, each of which intersects the other, the second front, back and side wall members being operably disposed in spaced apart relation to one another, so as to define another corner receiving region, the second front, back and side wall members further defining a second corner protector member, for substantially covering at least a portion of the front, back and side surfaces, respectively, of a second corner region of an article;

frangibility means for operably, yet separably connecting the first and second corner protector members to one another so as to enable their formation simultaneously, prior to deployment about respective first and second corner regions of an article.

2. The apparatus according to claim 1, wherein the first and second corner protector members are formed from a substantially flat articulable blank of paper material.

3. The apparatus according to claim 1, wherein the first and second corner protector members are separably connected to one another, prior to deployment, between at least one of their respective first and second front wall members, and their respective first and second back wall members.

4. The apparatus according to claim 3, wherein the frangibility means for operably separably connecting the first and second corner protector members to one another comprise:

at least one frangibility region disposed between at least one of the respective first and second front wall members, and the respective first and second back wall members, whereat the first and second corner protector members are separably connected to one another.

5. The apparatus according to claim 1, wherein at least one side wall member of each first and second pair of side wall members comprises:

a first side wall portion operably emanating from a front wall member;

a second side wall portion operably emanating from a corresponding back wall member, the first side wall portion and the second side wall portion being positionable in juxtaposed, substantially overlapping relationship to one another, when the front and back wall members are in spaced apart, substantially opposed parallel relationship to one another; and means for affixing the first side wall portion to the second side wall portion, when the front and back wall members are in their spaced apart, substantially opposed parallel relationship to one another.

6. The apparatus according to claim 1, wherein at least one of the side wall members operably emanates from at least one of its corresponding front and back wall members, and is demarcated therefrom by a fold line.

7. The apparatus according to claim 1, further comprising:

a third front wall member;

a third back wall member;

a thirst pair of side wall members, each of which intersects the other, the third front, back and side wall members being operably disposed in spaced apart relation to one another, so as to define a third corner receiving region, the third front, back and side wall members further defining a third corner protector member, for substantially covering at least a portion of the front, back and side surfaces, respectively, of a third corner region of an article;

a fourth front wall member;

a fourth back wall member;

a fourth pair of side wall members, each of which intersects the other, the fourth front, back and side wall members being operably disposed in spaced apart relation to one another, so as to define a fourth corner receiving region, the fourth front, back and side wall members further defining a fourth corner protector member, for substantially covering at least a portion of the front, back and side surfaces of a fourth corner region of an article;

means for operably, yet separably connecting the third and fourth corner protector members to one another so as to enable their formation simultaneously, prior to deployment about respective third and fourth corner regions of an article; and means for operably, yet separably connecting the first and second corner protector members to the third and fourth corner protector members, so as to enable their collective formation simultaneously, prior to deployment about first, second, third and fourth corner regions of an article.

8. The apparatus according to claim 7, wherein the third and fourth corner protector members are formed from a substantially flat articulable blank of paper material.

9. The apparatus according to claim 7, wherein the first, second, third and fourth corner protector members are all formed from a single, contiguous substantially flat articulable blank.

10. The apparatus according to claim 7, wherein the third and fourth corner protector members are separably connected to one another, prior to deployment, between at least one of their respective third and fourth front wall members, and their respective third and fourth back wall members.

11. The apparatus according to claim 7, wherein the means for operably separably connecting the third and fourth corner protector members to one another comprise:

at least one frangibility region disposed between at least one of the respective third and fourth front wall members, and the respective third and fourth back wall members whereat the third and fourth corner protector members are separably connected to one another.

12. The apparatus according to claim 7, wherein the means for operably separably connecting the third and fourth corner protector members to the first and second corner protector members comprise:

at least one frangibility region disposed between at least one of the respective third and fourth front wall members and the first and second front wall members, and the respective third and fourth back wall members and the first and second back wall members, whereat the third and fourth corner protector members are separably connected to the first and second corner protector members.

13. The apparatus according to claim 7, wherein at least one side wall member of each third and fourth pair of side wall members comprises:

a first side wall portion operably emanating from a front wall member;

a second side wall portion operably emanating from a corresponding back wall member, the first side wall portion and the second side wall portion being positionable in juxtaposed, substantially overlapping relationship to one another, when the front and back wall members are in spaced apart, substantially opposed parallel relationship to one another; and means for affixing the first side wall portion to the second side wall portion, when the front and back wall members are in their spaced apart, substantially opposed parallel relationship to one another.

14. The apparatus according to claim 7, wherein at least one of the side wall members operably emanates from at least one of its corresponding front and back wall members, and is demarcated therefrom by a fold line.

15. The apparatus according to claim 1, wherein the means for affixing comprise an adhesive material.

16. The apparatus according to claim 7, wherein the means for affixing comprise an adhesive material.

17. A blank of substantially flat sheet material for forming, upon articulation, the apparatus according to claim 1.

18. A blank of substantially flat sheet material for forming, upon articulation, the apparatus according to claim 7.

19. A method for forming an apparatus for the facilitated protection of two or more corner regions of an article, wherein at least two of the two or more corner regions each includes a front surface, a back surface disposed substantially opposite to the front surface and at least two intersecting side surfaces between said front and back surfaces, the method for forming an apparatus for the facilitated protection of two or more corner regions of an article comprising:

a) forming a blank having, at least, a first front wall member, a first back wall member, and a first pair of side wall members, one of the side wall members being disposed between the first front wall member and the first back wall member, the other of the side wall members being formed as two side wall portions, one side wall portion emanating from a free edge of the first front wall member and the other side wall portion emanating from a free edge of the first back wall member; and a second front wall member, a second back wall member, and a second pair of side wall members, one of the side wall members being disposed between the second front wall member and the second back wall member, the other of the side wall members being formed as two side wall portions, one side wall portion emanating from a free edge of the second front wall member and the other side wall portion emanating from a free edge of the second back wall member, the blank being formed so that the first and second front wall members, the first and second back wall members, and the respective side wall members disposed therebetween, are disposed substantially contiguously adjacent one another, respectively, with a line of frangibility disposed between the respective adjacent front, back and side wall members;

b) articulating the blank by folding so that the respective front and back wall members are disposed in spaced apart, substantially parallel relation to one another, the side wall members between the front and back wall members being disposed substantially perpendicular to the front and back wall members;

c) articulating the side wall portions emanating from the free edges of the front and back wall members so that the side wall portions from a corresponding pair of front and back wall members are disposed in substantially overlapping, juxtaposed relation to one another;

d) affixing the overlapped side wall portions to one another, so as to maintain the respective front and back wall in their spaced apart, substantially parallel relationship, so as to simultaneously form at least first and second corner protector members.

20. The method according to claim 19, further comprising the steps of:

e) separating the at least first and second corner protector members, along the line of frangibility, so as to enable deployment of the at least first and second corner protector members, about respective first and second corner regions of an article.

21. The method according to claim 19, wherein the step for forming a blank further comprises the step of forming the blank to also have a third front wall member, a third back wall member, and a third pair of side wall members, one of the side wall members being disposed between the third front wall member and the third back wall member, the other of the side wall members being formed as two side wall portions, one side wall portion emanating from a free edge of the third front wall member and the other side wall portion emanating from a free edge of the third back wall member; and a fourth front wall member, a fourth back wall member, and a fourth pair of side wall members, one of the side wall members being disposed between the fourth front wall member and the fourth back wall member, the other of the side wall members being formed as two side wall portions, one side wall portion emanating from a free edge of the fourth front wall member and the other side wall portion emanating from a free edge of the fourth back wall member, the blank being formed so that the third and fourth front wall members, the third and fourth back wall members, and the respective side wall members disposed therebetween, are disposed substantially contiguously adjacent one another, respectively, with a line of frangibility disposed between the respective adjacent front, back and side wall members, the blank further being formed so that the first and second front wall members are disposed substantially contiguously adjacent to the third and fourth front wall members, the blank thus formed permitting, upon articulation and affixation of same, the simultaneous forming of first, second, third and fourth corner connector members.

22. The method according to claim 19, wherein the step for forming a blank further comprises the step of forming the blank to also have third and fourth front wall members emanating from the first and second front wall members, respectively, third and fourth back wall members emanating from the first and second back wall members, respectively, and third and fourth pairs of side wall members, one pair of side wall members formed as mating side wall portions, emanating from free edges of the third and fourth front wall members and the third and fourth back wall members; and the blank being formed so that the third and fourth front wall members, are disposed substantially contiguously with the first and second front wall members, with a line of frangibility disposed therebetween, and the third and fourth back wall members, are disposed substantially contiguously with the first and second back wall members, with a line of frangibility disposed therebetween, the blank further being formed with a further pair of side wall members operably emanating from further respective free edges of one of the third and fourth front wall members and the third and fourth back wall members, and at least one attachment tab emanating from at least one of the further pair of side wall members, for affixed attachment to at least one of the other of the third and fourth front wall members and the third and fourth back wall members, upon articulation of the blank; the blank thus formed permitting, upon articulation and affixation of same, the simultaneous forming of first, second, third and fourth corner connector members.

* * * * *